United States Patent [19]

Haruch

[11] Patent Number: 4,815,665

[45] Date of Patent: Mar. 28, 1989

[54] AIR ASSISTED NOZZLE WITH DEFLECTOR DISCHARGE MEANS

[75] Inventor: James Haruch, Naperville, Ill.

[73] Assignee: Spraying Systems, Ill.

[21] Appl. No.: 75,621

[22] Filed: Jul. 20, 1987

Related U.S. Application Data

[63] Continuation-in-part of Ser. No. 815,117, Dec. 27, 1985, abandoned, which is a continuation of Ser. No. 602,227, Apr. 19, 1984, abandoned.

[51] Int. Cl.[4] ..... B05B 7/04; B05B 1/26

[52] U.S. Cl. ..... 239/432; 239/434; 239/523; 239/524

[58] Field of Search ..... 239/176, 399, 432–434, 239/521, 523, 524, 550, 590, 590.3, 590.5

[56] References Cited

U.S. PATENT DOCUMENTS

| | | | |
|---|---|---|---|
| 1,051,135 | 1/1913 | Linderborg | 239/432 |
| 1,176,870 | 3/1916 | Stenhouse | 239/432 |
| 1,177,884 | 4/1916 | Molesta et al. | 239/523 |
| 1,364,141 | 1/1921 | Reams | 239/523 |
| 1,520,048 | 12/1924 | Baird | 239/523 X |
| 2,530,671 | 11/1950 | Wahlim | 239/523 |
| 2,864,652 | 12/1958 | O'Brien et al. | 239/523 |
| 4,130,247 | 12/1978 | Healy | 239/523 |
| 4,330,086 | 5/1982 | Nysted | 239/432 X |
| 4,349,156 | 9/1982 | Haruch et al. | 239/432 |
| 4,591,099 | 5/1986 | Emory et al. | 239/434 X |

FOREIGN PATENT DOCUMENTS

| | | | |
|---|---|---|---|
| 24441 | 3/1981 | European Pat. Off. | 239/176 |
| 926427 | 5/1982 | U.S.S.R. | 239/434 |

*Primary Examiner*—Douglas C. Butler
*Assistant Examiner*—Mary Beth Jones

[57] ABSTRACT

An air assisted spray nozzle having a nozzle body formed with an elongated mixing and atomizing chamber having an air inlet orifice communicating with one end of the chamber, a liquid inlet orifice communicating with a side of the chamber, and a nozzle tip having a discharge orifice located at the end of the chamber opposite the air inlet orifice. Transversely directed stream of pressurized air and liquid enter and converge in the mixing and atomization chamber of the nozzle body causing preliminary atomization of the liquid, which is thereupon directed under the force of the high velocity air stream out the discharge orifice and against a deflector flange of the nozzle tip which further atomizes the liquid and directs it into a well-defined flat fan spray pattern with substantially uniform liquid particle size. To enhance preliminary atomization, the mixing and atomizing chamber has an inwardly extending liquid impingement post in diametrically opposed relation to the liquid inlet orifice, and to facilitate further atomization and controlled direction of the discharging spray the deflector flange defines an arcuate shaped guide surface which is substantially wider than the width of the discharge orifice and has a terminal lip transversely offset from the dischage orifice.

21 Claims, 2 Drawing Sheets

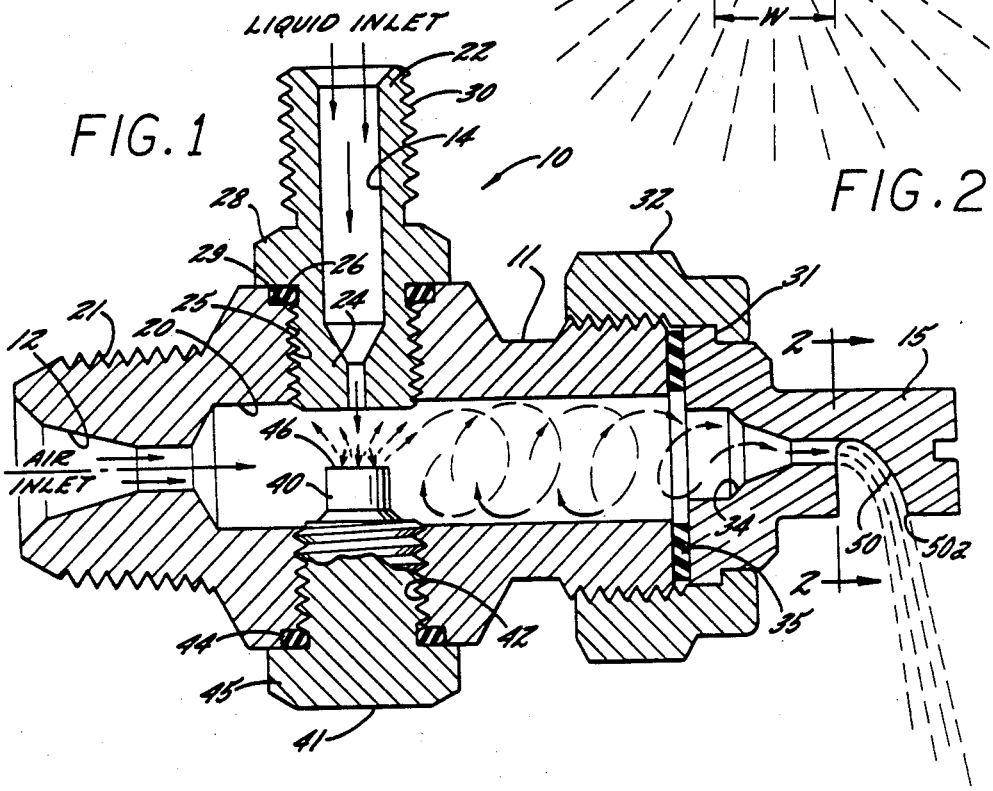
FIG. 3
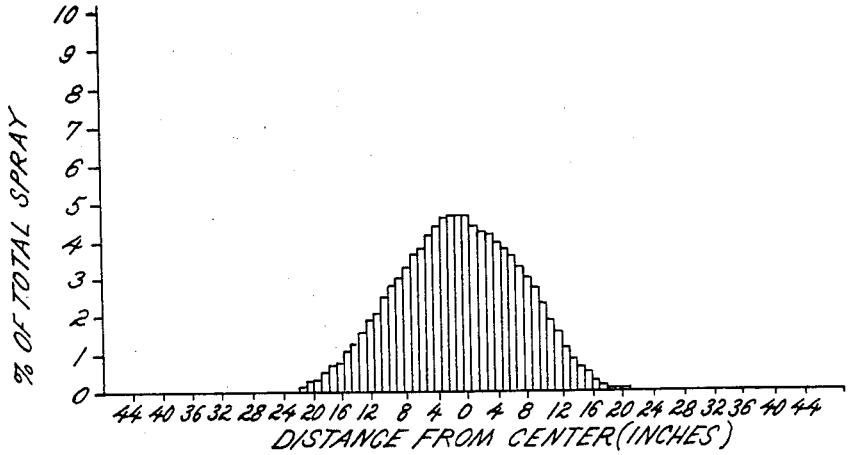

AIR ASSISTED NOZZLE WITH DEFLECTOR DISCHARGE MEANS

DESCRIPTION OF THE INVENTION

This application is a continuation in part of application Ser. No. 815,117, filed Dec. 27, 1985 now abandoned, which was a continuation of application Ser. No. 602,227 filed Apr. 19, 1984, now abandoned.

The present invention relates to spray nozzles, and more specifically, to an improved air assisted spray nozzle that finds particular but not exclusive utility in the agricultural application of chemical herbicides. In the application of agricultural chemicals, there has been a trend toward the use of relatively viscous materials, such as cotton seed oil, soybean oil, and certain petroleum based products, as the liquid carrier for the chemical so as to minimize the quantity of the liquid carrier that must be transported to the use sight. The use of such viscous carriers, however, has created difficulties in spraying of the chemical because of the inability to achieve proper spray particle break up, increased nozzle maintenance by virtue of clogging and the like, and the necessity for relatively high spraying pressures. While air assisted nozzles are available that facilitate particle break up, such air assisted nozzles generally have suffered from the drawback of nonuniformity in liquid distribution and particle size and the generation of excessively fine liquid particles.

While the purpose of spray nozzles is to break a liquid flow stream into a multiplicity of liquid particles, in the application of herbicidal chemicals, it is not desirable to atomize the liquid into the finest possible particles. Over atomized liquid droplets, such as those that are less than about 50 microns in diameter, are undesirable since they become easily airborne and drift, resulting in waste and possible damage to surrounding crops and vegetation. On the other hand, hydraulic nozzles that do not utilize air atomization often create such large liquid droplets, i.e. in excess of about 400 microns in diameter, that upon striking the plant surface, excessive run off and waste occurs.

To facilitate control of the spray distribution, and the uniformity of the application of the chemical, it also is desirable that the spray pattern have a generally flat fan-shaped configuration and that the liquid distribution be well defined. Preferably, a V or bell-shaped liquid distribution curve is desirable with greatest quantities of liquid being directed in the center of the spray pattern and progressively lesser quantities being distributed outwardly from the center. Such V-shaped liquid distribution pattern allows the sprays from a plurality of nozzles on a common mounting boom to be directed in predetermined overlapping relation so as to result in distribution of substantially uniform quantities of the liquid on the plant foliage. Prior air atomizing nozzles that generate overly fine particles further have suffered from the inability to permit good control in the liquid distribution.

It is an object of the present invention to provide an improved air assisted liquid spray nozzle adapted to produce a spray pattern with substantially uniformly sized liquid particles that are susceptible for the efficient and safe application of chemical herbicides.

Another object is to provide a spray nozzle as characterized above which produces a generally flat spray pattern having a well defined V or bell-shaped liquid distribution.

A further object is to provide a spray nozzle of the above kind that is adapted for spraying relatively viscous fluids with improved spray characteristics and without nozzle clogging.

Still another object is to provide a spray nozzle of the foregoing type that is operable at relatively low pressures and flow rates.

Yet another object is to provide a spray nozzle as characterized above which is relatively simple in construction, and thus, economical to produce and reliable to use.

Other objects and advantages of the invention will become apparent upon refernce to the following detailed description and accompanying drawings, in which:

FIG. 1 is a longitudinal sectional view of an illustrative spray nozzle assembly embodying the present invention;

FIG. 2 is a vertical section of the tip of the illustrative spray nozzle shown in FIG. 1, taken in the plane of line 2—2;

FIG. 3 is a diagram illustrating the liquid distribution of an air assisted nozzle according to the present invention, showing that progressively lessor quantities of liquid are distributed outwardly from the center of the spray pattern;

Figure 4:
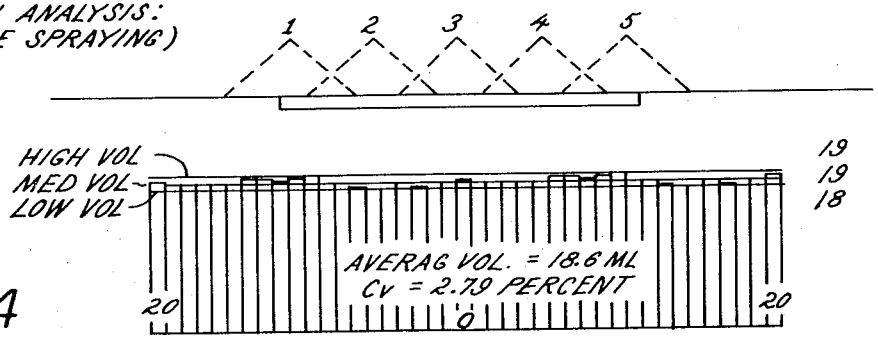
FIG. 4 is a diagram illustrating the substantially uniform liquid distribution achieved by overlapping the spray patterns of a plurality of nozzles according to the present invention.

While the invention is susceptible of various modifications and alternative constructions, a certain preferred embodiment has been shown in the drawings and will be described below in detail. It should be understood, however, that there is no intention to limit the invention to the specific form described but, on the contrary, the intention is to cover all modifications, alternative constructions and equivalents falling within the spirit and scope of the invention.

Referring now more particularly to FIG. 1 of the drawings, there is shown an illustrative spray nozzle assembly 10 embodying the present invention. The spray nozzle assembly 10 includes an elongated hollow nozzle body 11 having an air inlet orifice 12 formed in one end of the body, a liquid inlet orifice 14 disposed at a side of the body, in this instance located in perpendicular relation to the air inlet orifice 12, and a nozzle tip 15 mounted on an end of the body opposite the air inlet orifice 12. The air inlet orifice 12 extends into the nozzle body 11 in inwardly tapered fashion and communicates with an enlarged diameter mixing and atomizing chamber 20 which extends longitudinally through the remainder of the nozzle body. The air inlet orifice end of the nozzle body 11 is formed with external threads 21 for receiving an appropriate pressurized air supply line.

The liquid inlet orifice 14 in this instance is defined by a fitting 22 that has an inner end 24 in threaded engagement with a radial bore 25 that extends through a side wall of the nozzle body 11 to the chamber 20. An O-ring seal 26 is interposed between a radial mounting flange 28 of the fitting 22 and an annular seat 29 in the nozzle body 11. The fitting 22 has an outwardly extending end formed with external threads 30 upon which an appropriate liquid supply line may be mounted. In the application of agricultural chemicals, a liquid, such as water, cotton seed oil, soybean oil, or other liquid carrier with which the chemical or chemicals to be applied are mixed, would be supplied to the liquid inlet orifice 22, which has an inwardly tapered cofiguration and communicates with the chamber 20.

For mounting the nozzle tip 15 on the nozzle body 11, the tip 15 is formed with a peripheral flange 31 which is clamped against the end of the nozzle body 11 by a clamp nut 32 that threadedly engages the discharge end of the nozzle body 11. The nozzle tip 15 is formed with a discharge orifice 34 that communicates with the discharge endof the nozzle body chamber 20, and an annular seal 35 is interposed between the nozzle tip 15 and body 11 to sealthe perimeter of the tip.

In accordance with the invention, transversely directed streams of pressurized air and liquid enter and converge in the mixing and atomizing chamber of the nozzle body causing the preliminary atomization of the liquid, which is thereupon directed under the force of the high velocity air stream out of the nozzle discharge orifice and against a deflector flange of the nozzle tip which further atomizes the liquid and directs it into a well-defined, flat fan spray pattern with substantially uniformly sized particles which are large enough to resist undesired drifting during field application under most conditions and small enough to cling to permit foliage without excessive run off. To this end, as illustrated in FIG. 1, a high velocity air stream directed through the air inlet orifice 12 passes longitudinally into and through the mixing and atomization chamber. At the same time, liquid directed through the liquid inlet orifice 14 enters the chamber transversely to the high velocity air stream such that the liquid and air streams converge within the chamber 20.

To facilitate atomization of the converging liquid and air streams in the mixing and atomizing chamber 20, the chamber 20 has an inwardly extending impingement post or table 40 disposed in diametrically opposed relation to the liquid inlet orifice 14. The post 40 in this case is formed at the terminal end of a screw member 41 in threaded engagement with a radial bore 42 in the side wall of the nozzle body 11. An O-ring seal 44 again is interposed between an exterior mounting flange 45 of the screw member 41 and the nozzle body 11 for insuring a proper seal therebetween. The post 41 in this case defines a flat, circular impingment face 46 disposed in spaced relation to the outlet of the liquid inlet orifice 14. The screw member 41 is fixed in the nozzle body 11 so as to locate the impingement face 46 approximately on the longitudinal axis of the chamber 20 so that as liquid contacts the impingement face, it will be swept by the jet stream of pressurized air entering the chamber from the air inlet orifice 12. The liquid stream is thereby broken down into an atomized mixture with the air by the combined action of striking the impingement face 46 and being exposed to the high velocity air stream which induces turbulence to the resulting liquid particles, which continue to mix with the air stream as they are carried through the chamber 20 and discharge orifice 34 of the nozzle tip 15.

In carrying out the invention, the nozzle tip 15 is formed with a deflector flange 50 disposed transversely to the line of travel of the liquid particles exiting the discharge orifice 34 such that the particles forcefully strike the deflector flange and are further broken down and atomized into small particles of relatively uniform size, which are thereupon directed into a well-defined flat fan spray pattern transverse to the axis of the nozzle body 11. The deflector flange 50 in this instance has a significantly greater width "w" than the outlet of the discharge orifice 34 and defines an arcuate shaped defector surface which commences at the outlet of the discharge orifice 34 and proceeds in curved fashion to a terminal lip **50*a* transversely offset from discharge orifice 34. While the deflector flange 50** effectively enhances atomization of the discharging spray, the arcuate configuration of the flange is believed to permit better control of the spray pattern, such that the atomized liquid particles form a well-defined pattern of relatively narrow width.

The liquid distribution from the nozzle assembly 10 also is well defined, so as to facilitate the controlled uniform application of the liquid. As shown in FIG. 3, the nozzle assembly 10 produces a generally V or bell-shaped liquid distribution pattern, with the greatest quantity of liquid being directed in the center of the pattern and progressively lessor quantities being directed outwardly from the center. By establishing the proper height and axial spacing of a plurality of such nozzles on a mounting boom, as is known in the art, the spray patterns from a plurality of such nozzles can be directed in overlapping relation, as illustrated in FIG. 4, resulting in the substantially uniform distribution of liquid along the length of the spray boom. By virtue of the substantial uniformity of particle size, efficient chemical application can be achieved without significant waste by virtue of air drifting or run off from the foliage.

Figure 5:
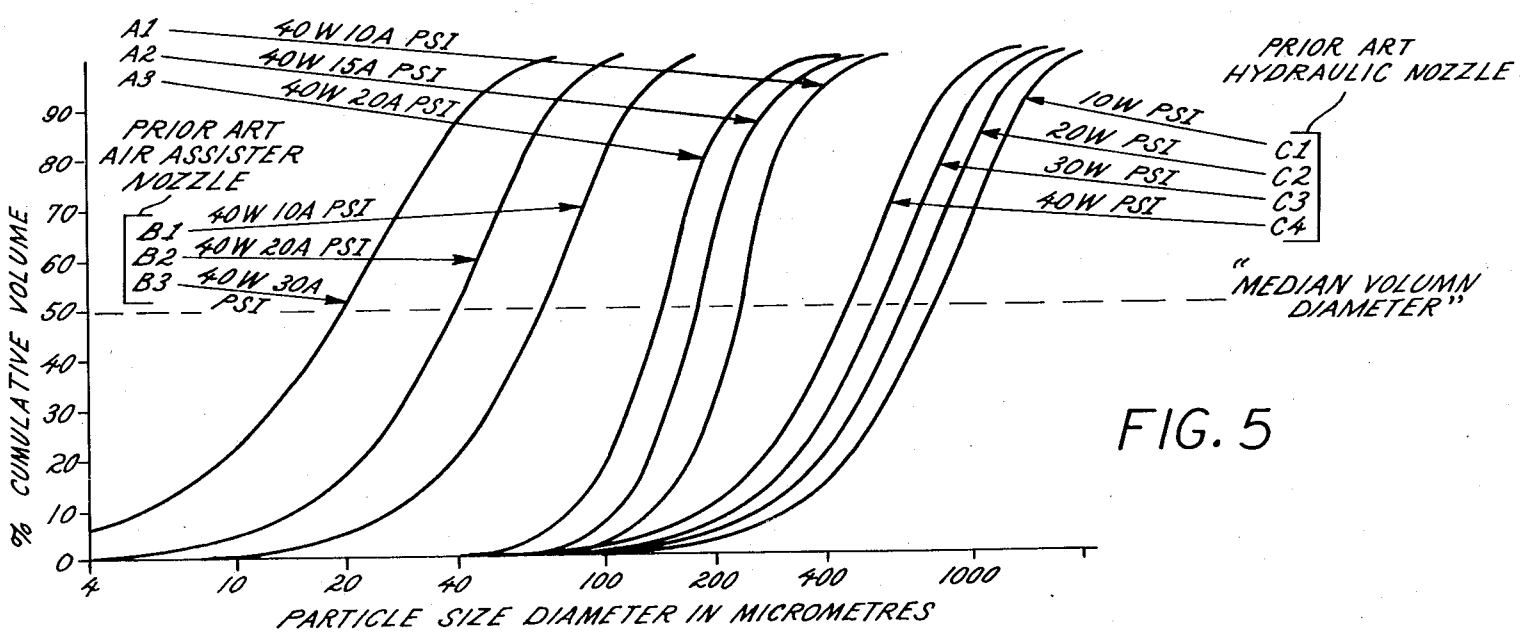
FIG. 5 is a diagram showing the particle size variation generated by a nozzle of the present invention in relation to the performance of a prior art air assisted nozzle and a prior art hydraulic nozzle.

Indeed, the nozzle assembly of the present invention has been found to permit spraying of chemical herbicides with unexpected superiority over prior art assisted nozzles or conventional hydraulic nozzles, because of its ability to generate more uniformly sized particles within the preferred size range of between about 50 and about 400 microns in diameter, which are more resistant to drift and are less prone to run off from the plant surface upon contact therewith. Referring to FIG. 5, there is shown a graphic comparison of the operation of the nozzle of the present invention in terms of particle size, (lines A-1, A-2, A-3) in relation to an air assisted nozzle of the type shown in U.S. Pat. No. 4,349,156 (lines B-1, B-2, B-3), and a hydraulic nozzle of the type shown in U.S. Pat. No. 2,864,652 (lines C-1, C-2, C-3) both prior patents being assigned to the same assignee as the present application.

The nozzle assembly 10 of the present invention was operated with a uniform inlet water pressure 40 psi (indicated as 40 w in FIG. 5) and the lines designated A-1, A-2 and A-3 depict the particle distribution when the nozzle is operated with air inlet pressures of 10, 15 and 20 psi, respectively. The graphs in each case trace the entire range of particle sizes in the spray spectrum versus the percentage of the volume of liquid spray. The "mean volume diameter" of a spray spectrum commonly is referred to as the particle diameter of which 50% of the particles are larger and 50% of the particles are smaller. Referring to line A-1, the mean volume diameter for the nozzle of the present invention when operated at a 10 psi air pressure is about 240 microns. In other words 50% of the liquid in the spray pattern are particles greater than 240 microns and 50% of the liquid are less than 240 microns. Line A-1 further depicts the entire spectrum of particle sizes, showing that they range from about 80 microns to about 40 microns. Only 10% of the volume of liquid sprayed comprises particles less than about 140 microns and only 10% are greater than 340 microns. Lines A-2 and A-3 depict operation of the nozzle assembly 10 of the present invention at progressively higher air pressures. Nevertheless, it can be seen that substantially all of the particles are within the preferred range of between about 50 microns and about 400 microns.

In contrast, the air assisted nozzle of a type similar to that shown in U.S. Pat. No. 4,349,156 has been found to generate much finer liquid particles, as depicted in lines B-1, B-2 and B-3. With reference to line B-1, about 30% of the liquid sprayed was in the form of particles which were less than 50 microns in diameter, in line D-2, about 65% was less than 50 microns in diameter, and line B-3, about 95% was less than 50 microns in diameter. The fine atomized mist which is generated by such nozzle resembles a cloud of mist, in striking contrast to the well defined flat spray pattern of the nozzle of the present invention which lends itself to relatively precise liquid distribution control during spraying. Lines C-1, C-2, C-3 and C-4, on the other hand, depict the particle spectrum of a hydraulic nozzle of the type shown in U.S. Pat. No. 2,864,652 and demonstrates that the vast majority of the liquid sprayed was in the form of liquid particles in excess of the preferred maximum size of 400 microns, with each of the four operations depicted producing particles in excess of 1000 microns in diameter.

The foregoing spray characteristics of the nozzle assembly 10 similarly can be achieved when viscous liquid materials, such as cotton seed oil, soybean oil, petroleum based products, or the like, are utilized as a liquid carrier for agricultural chemicals. The nozzle assembly further has been found to operate efficiently at relatively low pressures, such as on the order of 5 to 10 psi, and at low flow rates. At the same time, particular size and spray distribution may be varied with a high degree of control by controlling the air supply. The relatively simple construction of the nozzle not only facilitates economical manufacture, but has permitted the application of viscous liquid carriers without nozzle clogging or other maintenance problems which heretofore have plagued nozzles utilized for such purpose. While the nozzle of the present invention has been found to have particular utility in the application of agricultural chemicals, it is understood that it may be used for other spray applications. It will also be appreciated that while the nozzle tip has been shown in the illustrated embodiment, as a separate removable part from the nozzle body, alternatively, the discharge orifice and deflector flange could be made an integral part of the nozzle body.

I claim as my invention:

1. An air assisted spray nozzle comprising:

a hollow nozzle body, means defining an air inlet orifice thorugh which a pressurized air stream is directed into said body, means defining a liquid inlet orifice through which a pressurized liquid stream is directed into said body, means defining an impingement surface in said body, said impingement surface being disposed such that said liquid stream directed into said body from said liquid inlet orifice strikes said impingement surface at substantially a right angle thereto and a pressurized air stream directed into said body from said air inlet surface interacts with said liquid stream to cause preliminary break down and atomization of said liquid, means defining a discharge orifice downstream of said impingement surface through which said atomized liquid is directed, and means defining a deflector flange downstream of said discharge orifice and transverse to the direction of travel of said atomized liquid through said discharge orifice against which said atomized liquid impinges for causing further break down and atomization of said liquid into particles of substantially uniform size and the transverse direction of the further atomized liquid into a well-defined, flat fan spray pattern having a generally v-shaped liquid distribution curve with greatest quantities of said liquid being distributed in the center of the spray pattern and progressively lesser quantities being distributed outwardly from the center.

2. The air assisted spray nozzle of claim 1 in which said discharge orifice is in substantial longitudinal alignment with said air inlet orifice.

3. The air assisted spray nozzle of claim 2 in which said liquid inlet orifice is disposed at a right angle to said air inlet orifice.

4. The air assisted spray nozzle of claim 3 in which said body is formed with a mixing and atomizing chamber, and said impingement surface defining means is a post extending into said mixing and atomizing chamber.

5. The air assisted spray nozzle of claim 4 in which said impingement surface is located on the end of said post.

6. The air assisted spray nozzle of claim 5 in which said impingement surface is disposed on the longitudinal axis of said mixing and atomizing chamber.

7. An air assisted spray nozzle comprising:

a hollow nozzle body, means defining and air inlet orifice through which a pressurized air stream is directed into said body, means defining a liquid inlet orifice through which a liquid stream is directed into said body at an angle to the direction of said pressurized air stream, said body having a mixing and atomizing chamber with an impingement post extending into said chamber, said post being in substantial alignment with said liquid inlet orifice and having an end face against which said liquid stream directed into said chamber from said liquid inlet orifice impinges, said post being disposed transversely to the direction of travel of a pressurized air stream directed into said chamber from said air inlet orifice such that as said liquid stream contacts the end face of said post it is swept by the pressurized air stream to cause preliminary breakdown and atomization of said liquid, means defining a discharge orifice in fluid communication with said mixing and atomization chamber and through which said atomized liquid is directed, and means defining a deflector flange disposed downstream of said discharge orifice and transverse to the direction of travel of said atomized liquid through said discharge orifice against which said atomized liquid impinges for causing further breakdown and atomization of the liquid into particles of substantially uniform size and the transverse direction of the further atomized liquid into a well-defined, flat fan spray pattern having a generally v-shaped liquid distribution curve with greatest quantities of said liquid being distributed in the center of the spray pattern and progressively lesser quantities being distributed outwardly from the center.

8. The air assisted spray nozzle of claim 7 in which said discharge orifice is in substantial longitudinal alignment with said air inlet orifice.

9. The air assisted spray nozzle of claim 8 in which said liquid inlet orifice is disposed at an angle of about 90° to said air inlet orifice.

10. The air assisted spray nozzle of claim 9 in which said mixing and atomizing chamber has an elongated configuration disposed in axial alignment with said air inlet orifice and said discharge orifice.

11. The air assisted spray nozzle of claim 10 in which said post end face is disposed on the longitudinal axis of said mixing and atomizing chamber.

12. The air assisted spary nozzle of claim 7 in which said discharge orifice defining means is a nozzle tip removably mounted on said nozzle body.

13. The air assisted spray nozzle of claim 12 in which said deflector flange is an integrally formed part of said nozzle tip.

14. The air assisted spray nozzle of claim 13 in which said deflector flange defines an arcuate shaped deflector surface that changes direction of travel of the atomized liquid directed through said discharge orifice.

15. The air assisted spray nozzle of claim 14 in which said arcuate deflector surface extends from the outlet of said discharge orifice to a terminal lip transversely offset from said discharge orifice.

16. The air assisted spray nozzle of claim 15 in which said deflector flange has a width greater than the width of the outlet of said discharge orifice.

17. An air assisted spray nozzle comprising:

a hollow nozzle body, means defining an air inlet orifice through which a pressurized air stream is directed into said body, means defining a liquid inlet orifice through which a liquid stream is directed into said body at an angle to the direction of said pressurized air stream, said body having a mixing and atomizing chamber with an impingement post extending into said chamber, said post being in substantial alignment with said liquid inlet orifice and having an end face against which said liquid stream directed into said chamber from said liquid inlet orifice impinges, said post being disposed transversely to the direction of travel of a pressurized air stream directed into said chamber from said air inlet orifice such that as said liquid stream contacts the end face of said post it is swept by the pressurized air stream to cause preliminary breakdown and atomization of said liquid into liquid particles, a nozzle tip removably mounted on said nozzle body, said nozzle tip having a discharge orifice in fluid communication with said mixing and atomization chamber and through which said atomized liquid is directed, and said nozzle tip having a deflector flange disposed downstream of said discharge orifice and transverse to the direction of travel of said atomizaed liquid through said discharge orifice againt which said atomized liquid impinges for causing further break down and atomization of said liquid into particles of substantially uniform size and the direction of the further atomized liquid into a well-defined, flat fan spray pattern pattern having a generally v-shaped liquid distribution curve with greatest quantities of said liquid being distributed in the center of the spray pattern and progressively lesser quantities being distributed outwardly from the center.

18. The air assisted spray nozzle of claim 17 in which said mixing and atomizing chamber has an elongated configuration, said discharge orifice being in substantial longitudinal alignment with said air inlet orifice, and said liquid inlet orifice being disposed at an angle of about 90° to said air inlet orifice.

19. The air assisted spray nozzle of claim 18 in which said deflector flange defines an arcuate shaped deflector surface that changes the direction of travel of the atomized liquid directed through said discharge orifice, said deflector flange having a width greater than the width of the outlet of said discharge orifice and a terminal lip transversely offset from said discharge orifice.

20. The air assisted nozzle of claim 18 in which said deflector flange defines an arcuate shaped deflector surface that changes the direction of travel of atomized liquid directed through the discharge orifice by a substantial angle.

21. The air assisted nozzle of claim 18 in which said deflector flange defines an arcuate shaped deflector surface that changes the direction of travel of atomized liquid directed through the discharge orifice by an angle of slightly less than 90°.

* * * * *